US007346181B2

(12) United States Patent
Rivera

(10) Patent No.: US 7,346,181 B2
(45) Date of Patent: Mar. 18, 2008

(54) LOUDSPEAKER GRILLE

(75) Inventor: Dean Menchaca Rivera, Chula Vista, CA (US)

(73) Assignee: KSC Industries, Inc., San Diego, CA (US)

( * ) Notice: Subject to any disclaimer, the term of this patent is extended or adjusted under 35 U.S.C. 154(b) by 597 days.

(21) Appl. No.: 10/871,271

(22) Filed: Jun. 17, 2004

(65) Prior Publication Data

US 2005/0281429 A1 Dec. 22, 2005

(51) Int. Cl.
*H04R 1/02* (2006.01)

(52) U.S. Cl. ..... 381/391; 381/395

(58) Field of Classification Search ..... 381/391, 381/189, 395; 181/148, 150, 171, 199
See application file for complete search history.

(56) References Cited

U.S. PATENT DOCUMENTS 4,281,224 A * 7/1981 Castagna ..... 381/391
5,652,413 A * 7/1997 Mulera ..... 181/141

* cited by examiner

*Primary Examiner*—Brian Ensey
(74) *Attorney, Agent, or Firm*—Knobbe Martens Olson & Bear LLP

(57) ABSTRACT

A releasable loudspeaker grille is described that can be attached and removed from a loudspeaker without the use of tools. The grille flexes so that it can form, for example, static convex and concave states. When the grille is in the convex state, a plurality of tabs attached to the grille grasp onto or push against a contact or peripheral surface of the loudspeaker assembly to thereby affix the grille to the loudspeaker. When the grille is in the concave state, the plurality of tabs disengages from the contact surface of the loudspeaker assembly to thereby release the grille from the loudspeaker.

38 Claims, 9 Drawing Sheets

LOUDSPEAKER GRILLE

BACKGROUND OF THE INVENTION

1. Field of the Invention

The invention relates to the field of audio system loudspeaker grilles.

2. Description of the Related Art

The popularity of ceiling and wall-mounted loudspeakers in various types of buildings has grown steadily over the past decade. A variety of methods and devices for mounting loudspeakers in these locations have therefore been developed. When mounting loudspeakers in ceilings, difficulties arise with the attachment of the grille to the loudspeaker.

A grille is often attached to a flange or housing by the use of screws, clips or is press-fitted onto a grille trim ring or flange. These attachment methods typically require the use of tools to fasten screws or clip hardware that securely attaches or detaches the grille. Installation using these methods can be very time consuming. Magnets have been used to attach grilles without the use of tools. Although this method allows the grille to be easily and quickly attached and detached, the use of magnets is not cost effective. Besides the cost of the magnets, the use of magnets limits the materials that may be selected for the grill material to materials that are magnetically attracted to the magnets.

SUMMARY OF THE INVENTION

The systems and methods have several features, no single one of which is solely responsible for its desirable attributes. Without limiting the scope as expressed by the claims that follow, its more prominent features will now be discussed briefly. After considering this discussion, and particularly after reading the section entitled "Detailed Description of the Preferred Embodiments" one will understand how the features of the system and methods provide several advantages over traditional systems and methods.

One aspect is a grille configured to releasably attach to a circular receiving member of a loudspeaker where the receiving member has a diameter that defines a contact surface. The loudspeaker is configured to broadcast sound through the grille. The grille comprises a cover configured to reversibly deform between a static convex state and a static concave state and a plurality of flexible tabs spaced about the cover and forming a first inside diameter when the cover is in the convex state and forming a second inside diameter when the cover is in the concave state, wherein the first inside diameter is less than the second inside diameter and the diameter of the contact surface on the receiving member.

Another aspect is a loudspeaker assembly configured to fit in a wall or ceiling. The loudspeaker assembly comprises a loudspeaker, a receiving member having a diameter defining a contact surface, and a grille. The grille has a cover configured to reversibly deform between a static convex state and a static concave state and a plurality of flexible tabs spaced about the cover and forming a first inside diameter when the cover is in the convex state and forming a second inside diameter when the cover is in the concave state, wherein the first inside diameter is less than the second inside diameter and the diameter of the contact surface on the receiving member.

Yet another aspect of the invention is a method of attaching and detaching a grille to a loudspeaker installed into a wall or ceiling, wherein the grille can reversibly deform between a static convex state and a static concave state. The method comprises positioning the grille over the loudspeaker, wherein the grille includes a plurality of flexible tabs spaced about the grille, deforming the grille into the convex state, sliding the plurality of tabs around the loudspeaker so that the grille is fixedly attached to the loudspeaker, deforming the grille into the concave state, and removing the grille from the loudspeaker.

Still another aspect is a method of attaching a grille to a loudspeaker that comprises deforming the grille into a first state having a first diameter, positioning the grille onto the loudspeaker, and deforming the grille into a second state having a second diameter so that the grille is fixedly attached to the loudspeaker.

A further aspect of the invention is a method of detaching a grille from a loudspeaker that comprises deforming the grille from a first state having a first inner diameter to a second state having a second inner diameter, wherein the grille is fixedly attached to the loudspeaker when in the first state, and removing the grille from the loudspeaker.

Another aspect of the inventions is a grille configured to releasably attach to a receiving member of a loudspeaker, the receiving member having a contour, which defines a contact surface, the loudspeaker being configured to broadcast sound through the grille. The grille comprises a cover configured to reversibly deform between a first stable state and a second stable state, the cover forming a first inside diameter when the cover is in the first state and forming a second inside diameter when the cover is in the second state, wherein the first inside diameter is different than the second inside diameter such that the cover engages the contact surface when the cover is in the first state.

A further aspect of the invention is a loudspeaker assembly configured to fit in a wall or ceiling, the loudspeaker assembly comprises a loudspeaker, a receiving member having a diameter defining a contact surface, and a grille. The grille having a cover configured to reversibly deform between a first stable state and a second stable state, said cover forming a first inside diameter when the cover is in the first state and forming a second inside diameter when the cover is in the second state, wherein the first inside diameter is different than the second inside diameter such that the cover engages the contact surface when the cover is in the first state.

DETAILED DESCRIPTION OF THE PREFERRED EMBODIMENTS

Embodiments of the invention will now be described with reference to the accompanying figures, wherein like numerals refer to like elements throughout. The terminology used in the description presented herein is not intended to be interpreted in any limited or restrictive manner simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

Figure 1:
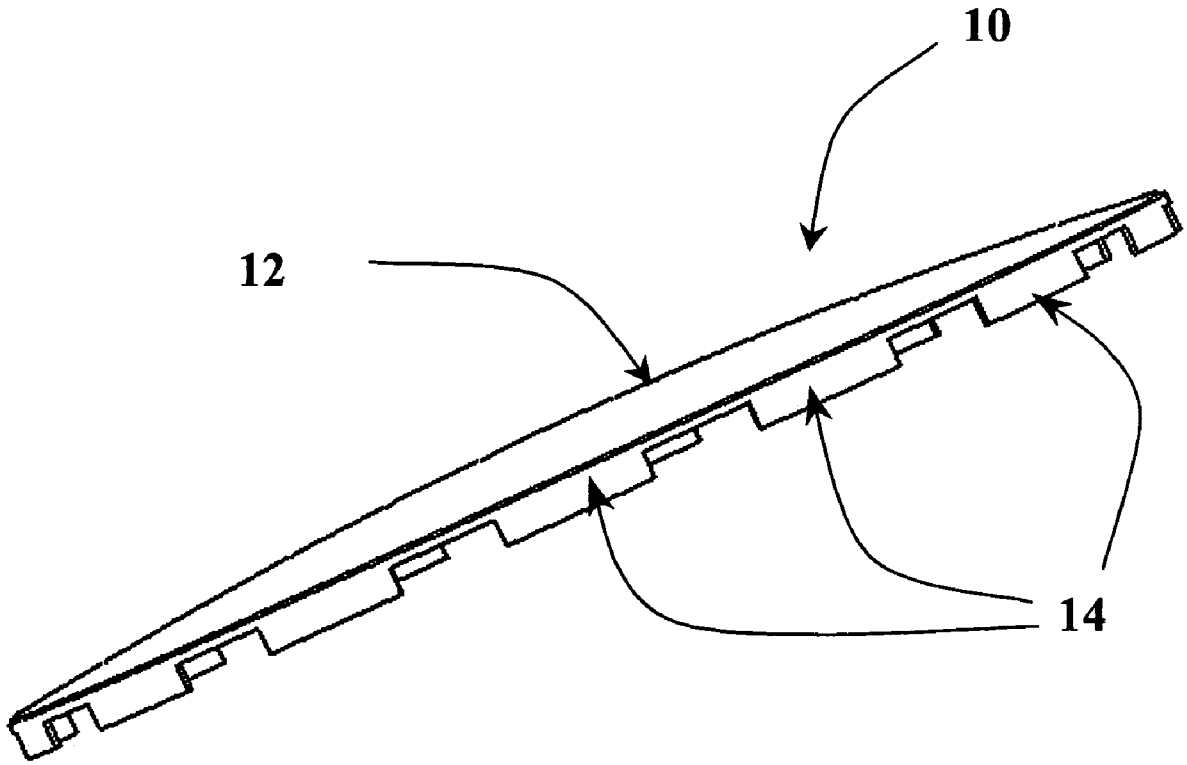
FIG. 1 is a perspective side view of one embodiment of a loudspeaker grille in a grabbing or holding state.
Figure 2:
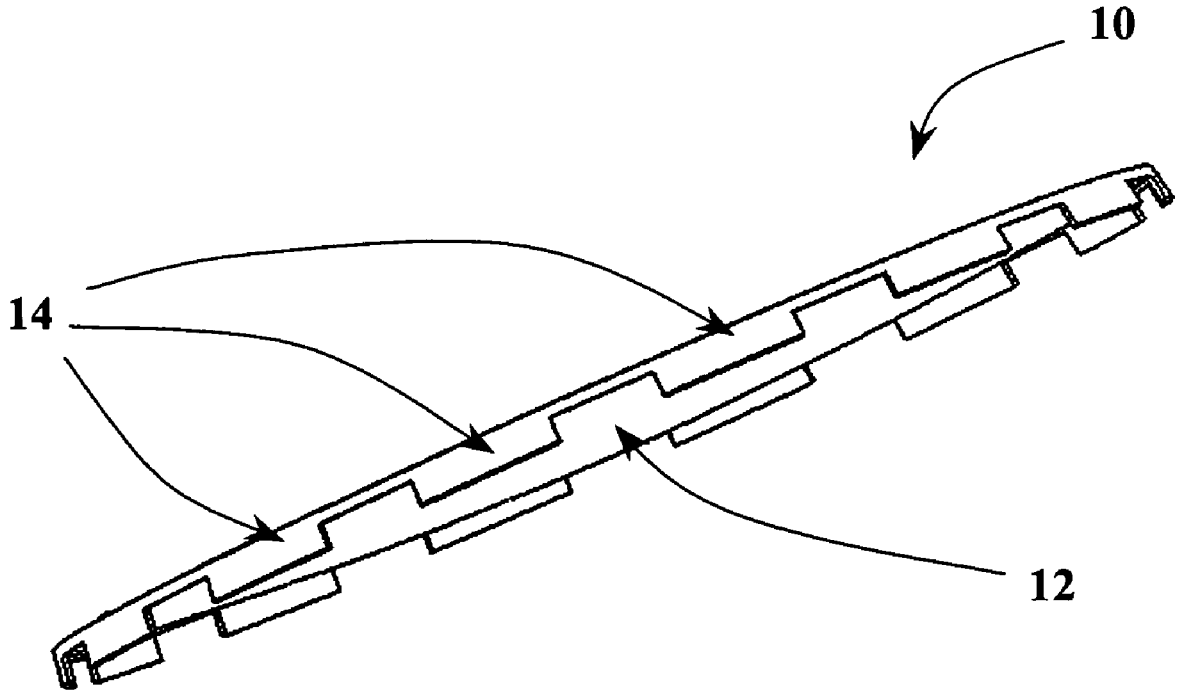
FIG. 2 is a perspective side view of the loudspeaker grille illustrated in FIG. 1 in a release state.

FIG. 1 is a perspective side view of a loudspeaker grille 10 in accordance with one embodiment of the present invention. The loudspeaker grille 10 in FIG. 1 is in a grabbing or holding state as will be explained below. In contrast to FIG. 1, FIG. 2 is a perspective side view of the loudspeaker grille 10 from FIG. 1 in a released state. The loudspeaker grille 10 in FIGS. 1 and 2 is easily attached and detached, and has been designed to fit onto an in-wall or in-ceiling loudspeaker.

The grille 10 can be securely attached and detached from the loudspeaker easily and quickly without the use of tools. This feature is particularly desirable for commercial in-ceiling loudspeaker products where the installation requires multiple loudspeakers be installed into the ceiling or wall of the structure. It is not uncommon for the grille 10 to be attached and removed several times during the installation process to facilitate access to controls located behind the grille. For example, an attenuator switch may be located behind the grille 10.

The loudspeaker grille 10 comprises a cover 12 and a plurality of tabs 14. The plurality of tabs 14 illustrated in FIG. 1 is arranged around the outer circumference of the cover 12. The plurality of tabs 14 are preferably aligned with a contact surface on the loudspeaker housing or trim ring regardless of the size of the cover 12. Depending on the configuration of the cover 12, the plurality of tabs 14 may be located around the outer circumference or around an inner diameter of the cover 12, or on an integral trim member to the cover 12.

Figure 3:
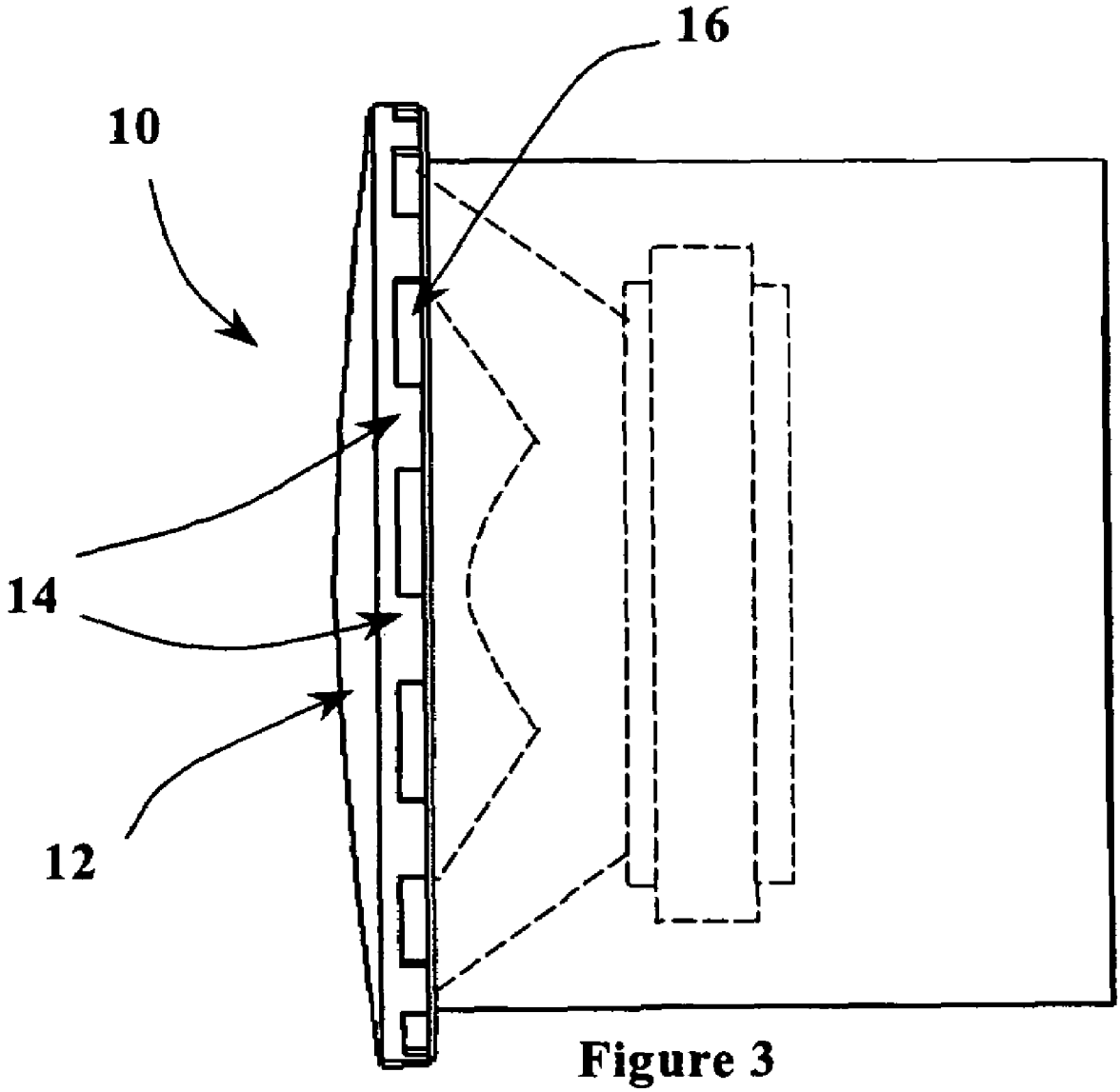
FIG. 3 is a side view of the loudspeaker grille illustrated in FIG. 2 in the grabbing or holding state and being attached to a receiving member in the form of a loudspeaker flange.
Figure 5A:
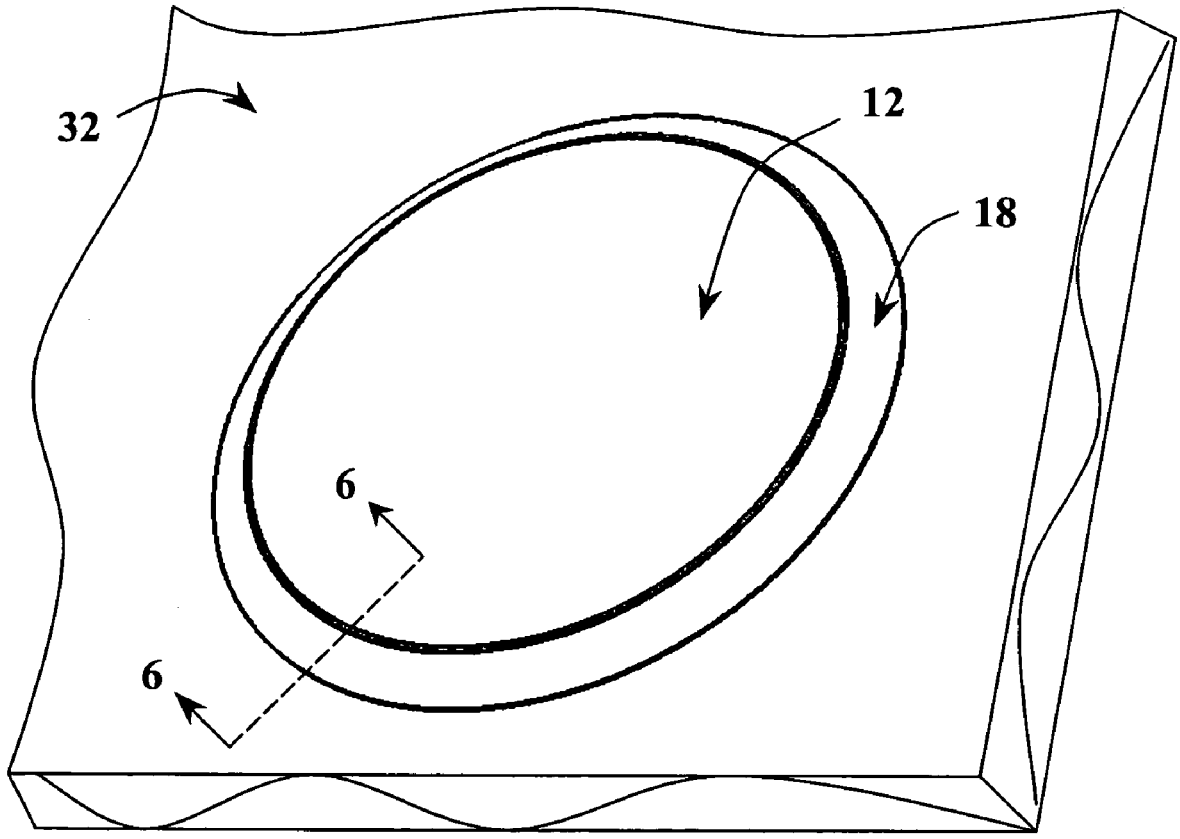
FIGS. 5(*a*)-5(*c*) illustrates an exemplary set of steps in a process for detaching the loudspeaker grille of FIG. 2 from a receiving member in the form of a trim ring.
Figure 5B:
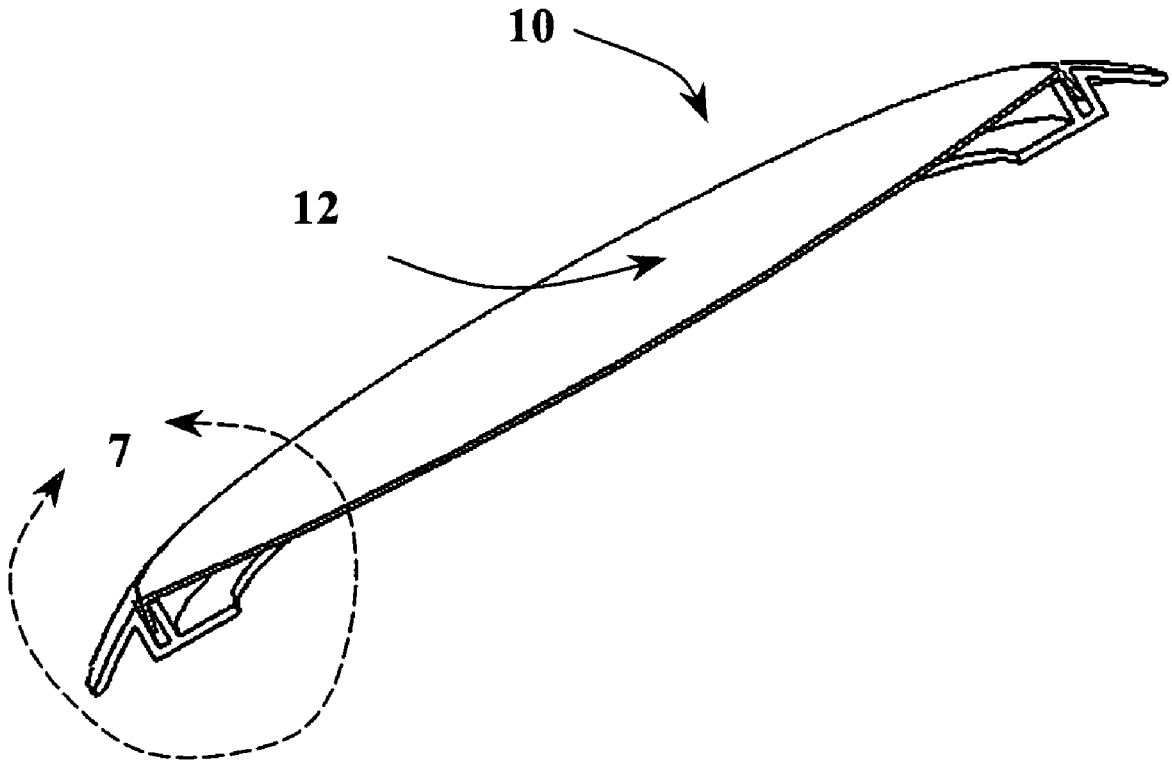
Figure 5C:
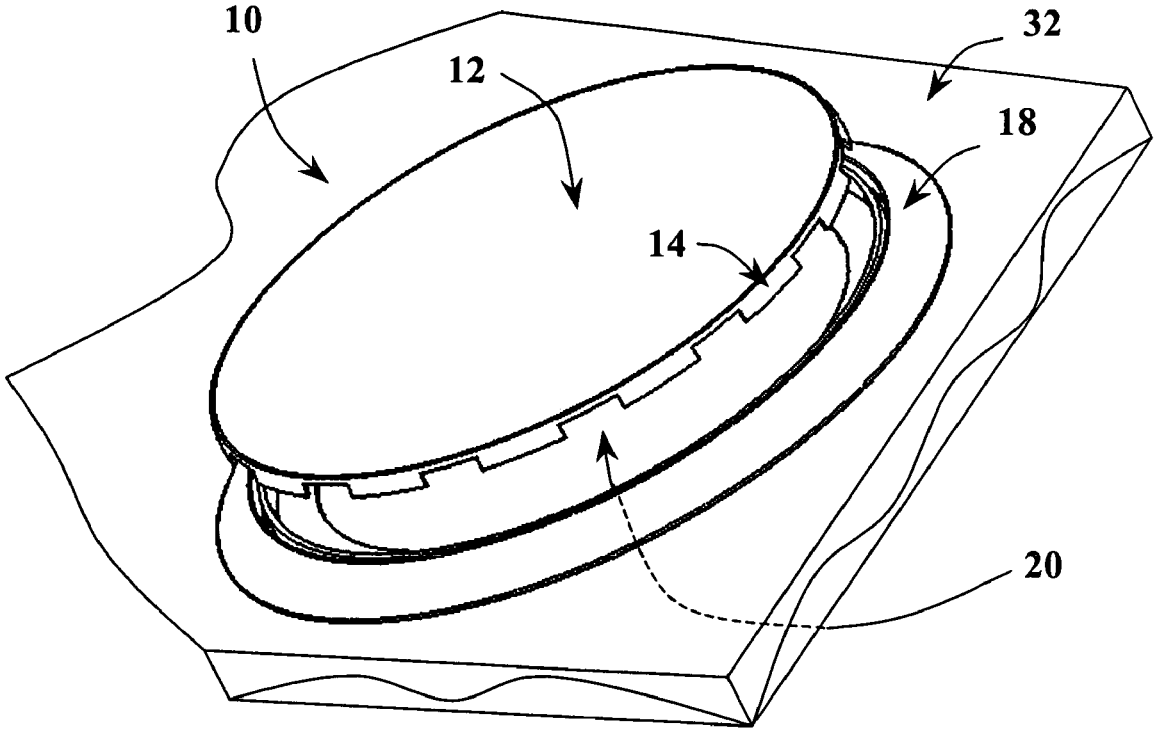

As will be explained below and is illustrated in FIGS. 3, 5(*a*), and 5(*b*), the plurality of tabs 14 provide the grabbing force to hold the grille 10 onto a flange or trim ring of the loudspeaker assembly. The quantity of tabs used can range from as few as two to as many as the amount of material around the outer diameter of the grille edge allows. Adjacent tabs are separated by an open area or slit to allow the tabs to move relative to the cover 12.

The cover 12 preferably has a domed or convex shape, which provides an arched support force that angles the tabs 14 towards the center of the cover 12. While the cover 12 is described as having a domed shape, the radius of curvature of the cover 12 may be large so that the curvature of the cover 12 is not easily perceptible to the naked eye. In this way, the cover may have a flat appearance. Furthermore, portions of the cover 12 may have a different radius of curvature or may have a planar shape. For example, a portion of the cover 12 may have a flat appearance around the perimeter of the cover 12.

When the cover 12 is in the grabbing or holding state, the tabs 14 grab on to or push against a contact surface of the trim ring or flange. To reduce the grabbing force of the tabs 14 against the trim ring or flange, the center of the cover 12 is pushed. When pushed in, the cover 12 is forced into a bowl-shape or release state. This release or concave state moves the tabs 14 away from the center of the cover 12 and thereby releases the tabs 14 from grabbing on to the trim ring or flange. This pressing in action quickly releases the grille 10 from the trim ring or flange.

In another embodiment, the tabs 14 push away from the center of the cover 12 when in the grabbing or holding state. An outside surface of the tabs 14 pushes against a contact surface of the trim ring or flange. To reduce the grabbing force of the tabs 14 against the trim ring or flange, the center of the cover 12 is popped out. When popped out, the cover 12 is forced into the release state. This release or convex state moves the tabs 14 towards the center of the cover 12 and thereby releases the tabs 14 from pushing against the trim ring or flange. This pressing in action quickly releases the grille 10 from the trim ring or flange.

The grille 10 may be constructed in any of a variety of ways, which will be well known to one of skill in the art. For instance, the cover 12 and tabs 14 may be integrally molded, such as by injection molding. Alternatively, the cover 12 and the plurality of tabs 14 are separately manufactured and attached using any well-known adhesive or attachment method (i.e. screws, welds or the like).

The material properties of the grille 10 are selected to allow a reversible deformation between the grabbing or convex state and the release or concave state. The grille 10 preferably comprises a durable, flexible material. Any material can be used for the cover 12 that is capable of elastically or plastically deforming. These can include plastics and other polymers as well as any flexible metal, or any other flexible material known in the art. Suitable materials include aluminum, steel, tin, composites such as polypropylene, polyethylene, polycarbonate, polyvinylchloride, polyurethane, nylon, olefin, acrylic, polyester, moldable silicon, thermoplastic urethane, thermoplastic elastomers, thermoset plastics and the like. The grille 10 is preferably formed with materials such as spring metal, aluminum alloys, stainless steel, tin, and plastics. However, other materials can be used.

The memory of the convex or rest shape of the grille 10 is retained even when the grille 10 is deformed into a concave shape. This memory allows the grille 10 to be easily deformed back into the convex shape. The material properties of the grille 10 ensure that the grille 10 will return to its convex or formed position and thereby retain its grabbing properties. Additional support and protection can be provided to the grille 10 by painting or plating the material.

The flexible nature of the cover 12 allows the cover 12 to be easily deformed or deflected. Preferably, as the cover 12 is deformed to form a shape, the plurality of tabs 14 moves in concert with the cover 12. For example, the cover 12 can have a convex shape as illustrated in FIG. 1 where the grille 10 is configured for attachment to a loudspeaker housing. To remove the grille 10 from the loudspeaker, the center of the cover 12 is pushed in to form a concave shape as illustrated in FIG. 2.

The cover 12 preferably includes one or more holes or perforations, which extend through the cover 12. These holes or perforations allow the sound waves emanating from the loudspeaker to exit the loudspeaker and enter the listening area. For installations where it is desirable for the loudspeaker to have a non-perforated surface to thereby camouflage the grille surface, for example, an in-wall enclosure for a subwoofer, the cover 12 may have no perforations. The subwoofer broadcasts low frequencies, which are not appreciably attenuated in such an installation.

FIG. 3 is a side view of the loudspeaker grille 10 in the grabbing or holding state. The grille 10 is attached to a receiving member in the form of a loudspeaker flange 16. The receiving member is a portion of the loudspeaker assembly that provides an accessible contact surface for the grille 10. Once the loudspeaker is installed in the wall or ceiling, the grille 10 is attached thereto forming an aesthetically pleasing surface that is in harmony with the surrounding wall. When the cover 12 is in the convex shape, the plurality of tabs 14 is configured to grab or hold onto the loudspeaker flange 16 of the loudspeaker. The cover 12 in FIGS. 1 and 3 is in the convex shape.

Figure 4:
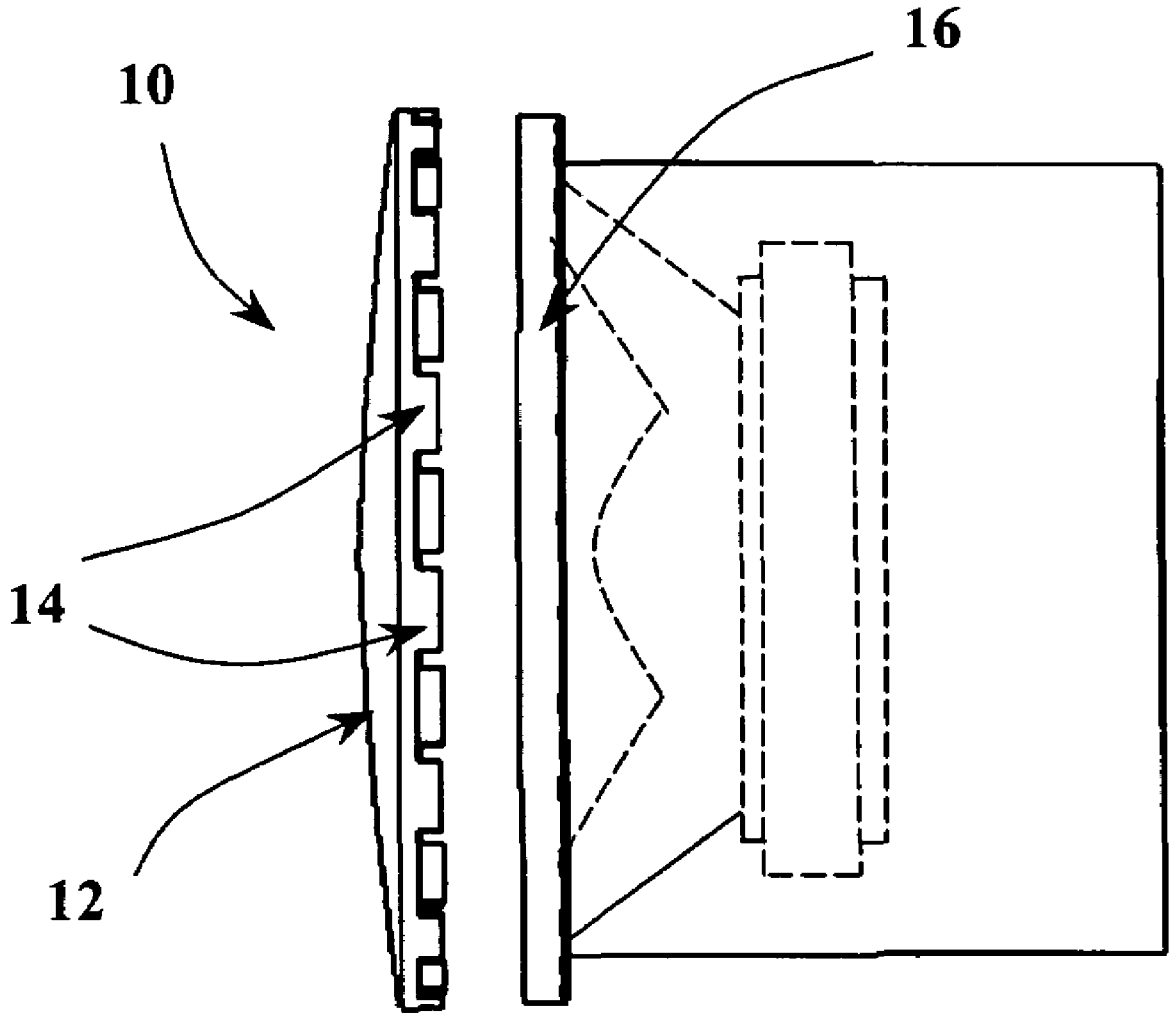
FIG. 4 is a perspective view of the loudspeaker grille, illustrated in FIG. 2, in the released state and detached from the loudspeaker flange.

FIG. 4 is a perspective view of the loudspeaker grille 10 from FIG. 3 when in the release state and detached from the loudspeaker flange 16. To detach the grille 10 from the loudspeaker flange 16, the center of the cover 12 is deformed in a direction towards the loudspeaker. Once the cover 12 is in the release or concave state, the plurality of tabs 14 flexes away or retracts from the flange 16 to thereby facilitate detachment of the grille 10 from the loudspeaker. For ease of explanation, the cover 12, when in this release state, has a concave shape. The use of the terms convex shape and concave shape in the description of the invention is provided to illustrate exemplary shapes. The cover 12 may have other appearances or shapes and still fall within the scope of the invention. As a point of reference, the shapes described herein are viewed from a location in front of the loudspeaker.

Loudspeakers can be attached on the surface of the wall 32 (i.e. front mount) or can be mounted from behind the wall (rear mount) depending on, for example, the design of the loudspeaker and whether the backside of the wall 32 is accessible. In either case, the trim ring 18 is used to provide a smooth interface with the wall 32. The trim ring 18 may be attached to the loudspeaker housing using, for example, screws, clips, or other methods of attachment, which are well known in the art. The locations where the screws attach the trim ring 18 to the loudspeaker are typically accessible from the listening area to ease installation. Generally, for rear mounted loudspeakers, a fastener attaches the trim ring 18 through the wall 32 and to the loudspeaker housing. For surface mounted loudspeakers, the fastener often attaches the trim ring 18 directly to the loudspeaker housing. With either arrangement, the grille 10 attaches to the trim ring 18 and can preferably cover any exposed screws or clips. Thus, an aesthetically pleasing appearance of the wall 32 is maintained.

While trim rings 18 are often utilized for loudspeaker installations, the invention is not so limited. A trim ring 18 is often a separate component from the loudspeaker housing. The grille 10 can be attached to the trim ring 18 as illustrated in FIG. 5(*a*) or to a flange 16 as illustrated in FIG. 3. Thus, the grille 10 can attach to an edge or flange around the loudspeaker housing or to a trim ring 18 of the loudspeaker. The illustrated trim ring is only exemplary and may take on other forms known to one having ordinary skill in the art. Desirably, the grille 10 provides a borderless appearance when configured for attachment to the edge or flange of the loudspeaker.

The trim ring 18 illustrated in FIGS. 5(*a*)-5(*c*), 6, and 7 includes an opening 20 bordered by a channel 22. As illustrated in FIGS. 5(*a*) and 5(*c*), the cover 12 is sized to fit over the opening in the trim ring 18. However, the cover 12 may extend beyond the surface of the opening 20. For example, the cover 12 can include an integral trim member, which extends beyond the perimeter of the housing for the loudspeaker. Further, the plurality of tabs 14 may be located on the integral trim member or on the cover 12.

Figure 6:
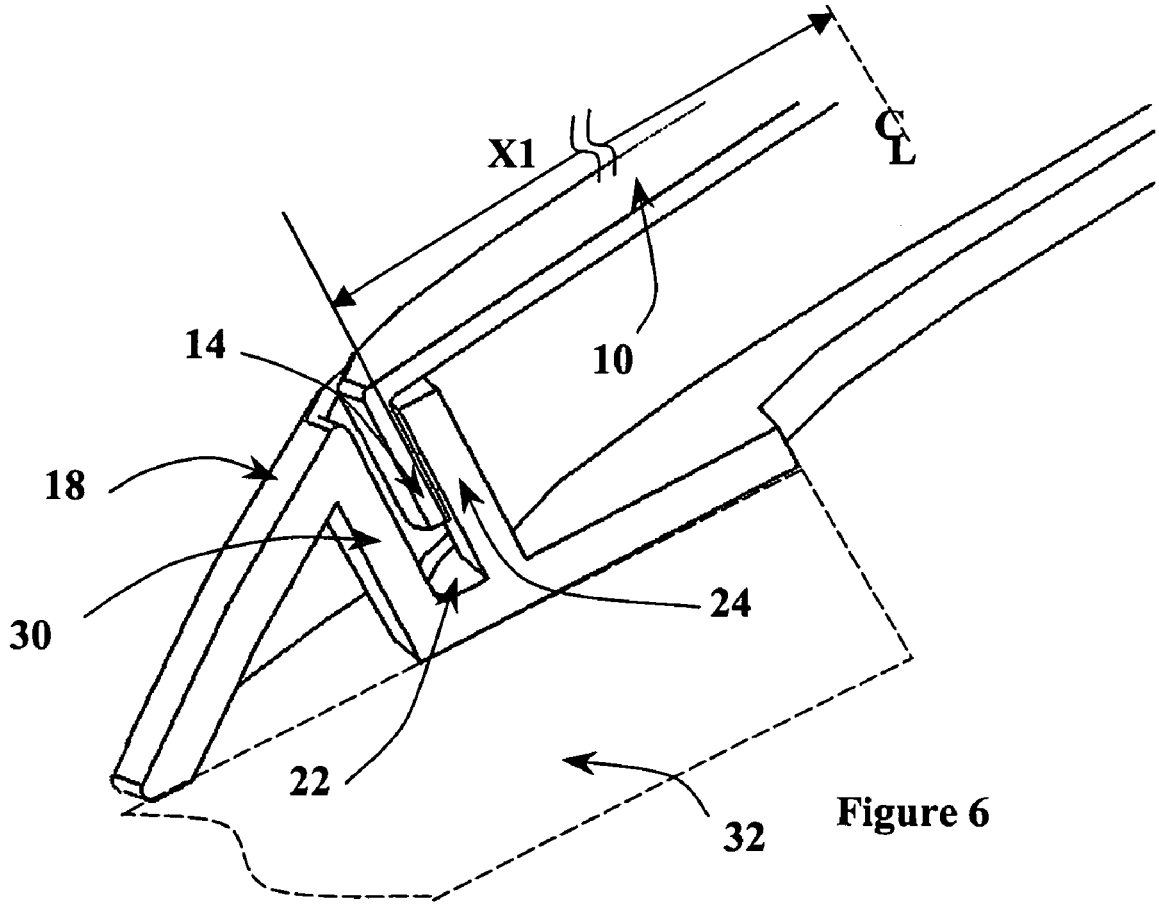
FIG. 6 is a cross-section taken along line 6-6 of FIG. 5(*a*) showing one of the plurality of tabs in the grabbing or holding state against an inside wall of the trim ring.
Figure 7:
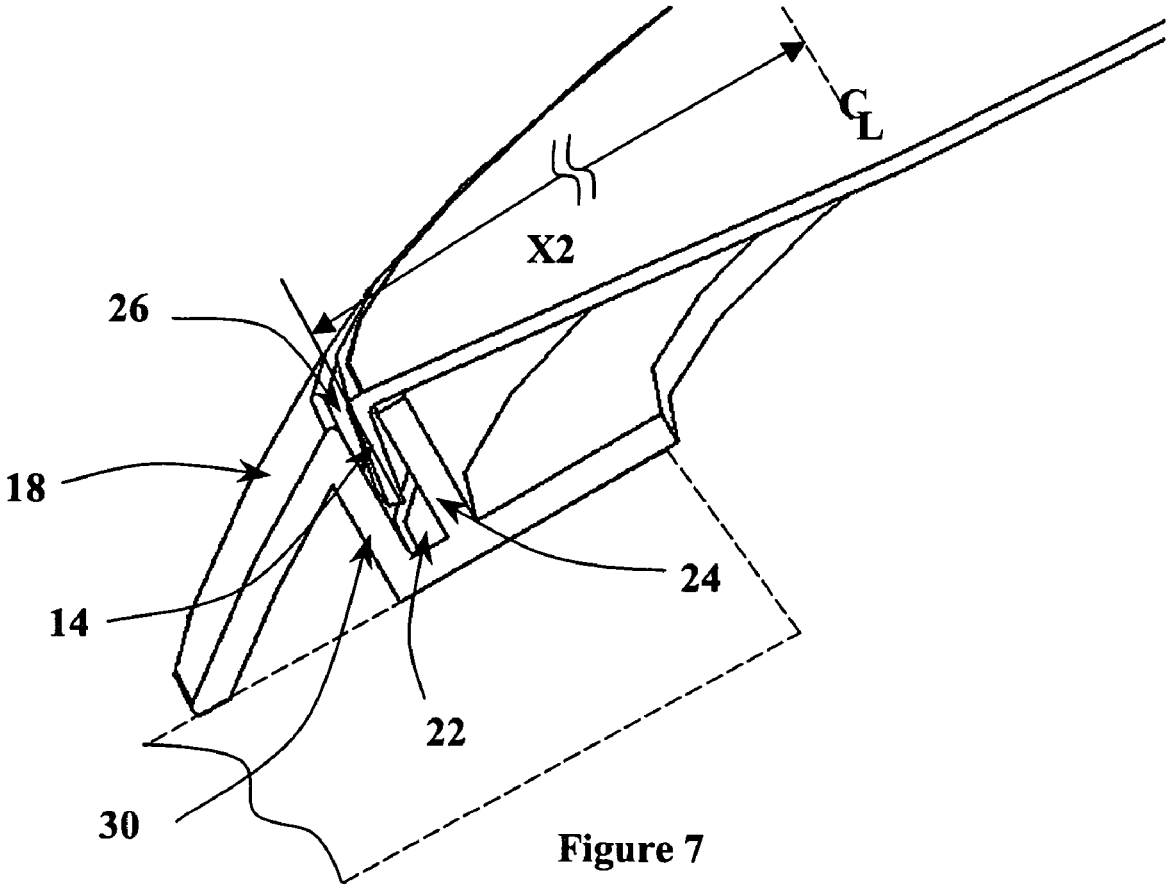
FIG. 7 is a view taken along line 7 of FIG. 5(*b*) showing one of the plurality of tabs flexed or angled away from the inside wall of the trim ring thereby facilitating detachment of the grille from the loudspeaker.

As illustrated most clearly in FIGS. 6 and 7, the channel 22 borders or circumscribes the opening 20 and includes an inside wall 24, an outside wall 30, and a channel opening 26 there between. The opening 26 of the channel 22 faces in a direction away from the loudspeaker and allows ingress and egress for the plurality of tabs 14. At least a portion of the inside wall 24 forms at least one contact surface for the plurality of tabs 14 to grip against when the grille 10 is attached to the loudspeaker. The inside wall 24 may be arranged perpendicular to the wall 32 or have a frustoconical shape that slightly tapers in a direction towards or away from the loudspeaker. Preferably, the inside wall 24 is perpendicular or has a slight taper towards the loudspeaker.

To enhance frictional forces between the plurality of tabs 14 and the inside wall 24, the surface of the inside wall 24 may be treated, roughened, or indented. For example, an adhesive may be applied to the inside wall 24 which would adhere to the plurality of tabs 14. Additionally, or in the alternative, the surface finish of the contact portion of the inside wall 24 and/or the surface finish of the contact surface on the plurality of tabs 14 is selected to provide a more graspable surface for the tabs 14. With any of these features or combination of features, the trim ring 18 preferably provides an adequate contact surface onto which the plurality of tabs 14 can easily engage or disengage.

FIGS. 5-7 illustrate an exemplary set of steps in a process for detaching the loudspeaker grille of FIG. 2 from the trim ring 18. In FIGS. 5(*a*) and 6, the grille 10 is attached to the trim ring 18 of the loudspeaker in an installed or holding state. The trim ring 18 provides a transition between the cover 12 and wall 32. As explained above, the installed cover 12 can have a convex, almost flat, or flat shape. The cover 12 preferably has a shape when attached to the trim ring 18, which allows the plurality of tabs 14 to grip against the inside wall 24. When installed, surface friction created by the contact between the plurality of tabs 14 and the inside wall 24 keeps the grille 10 adhered to the trim ring 18.

FIG. 6 is a cross-section taken along line 6-6 of FIG. 5(*a*) showing one of the pluralities of tabs 14 in the grabbing or holding state. The tab 14 is in contact with the inside wall 24 of the trim ring 18. This contact allows the grille 10 to adhere to the trim ring 18 without the use of screws or clips. When the grille 10 is adhered to the trim ring 18, the plurality of tabs 14 is located at a radius X1 from the centerline of the cover 12. The radius X1 is slightly less than the radius of the inside surface 24 so that the plurality of tabs 14 form an interference fit with the inside surface 24 of the trim ring 18 when the grille 10 is installed on the loudspeaker. The interference fit between the tabs 14 and the trim ring 18 holds the grille 10 against the loudspeaker. For ease of explanation, the adjacent wall 32 is illustrated in FIG. 6 with dashed lines.

In FIG. 5(*b*), the cover 12 of the grille 10 has been pushed towards the loudspeaker to form a concave shape in the surface of the cover 12. Pushing the cover 12 retracts or flexes the plurality of tabs 14 of FIG. 7 in a direction away from the inside wall 24 and away from the centerline of the cover 12. With the plurality of tabs 14 retracted, the interference fit between the inner surface of the tabs 14 and the inside wall 24 of the trim ring 18 is reduced or eliminated.

FIG. 7 is a view taken along line 7 of FIG. 5(*b*) showing one of the plurality of tabs 14 flexed or angled away from the inside surface 24 of the trim ring 18 thereby facilitating detachment of the grille 10 from the loudspeaker. The plurality of tabs 14 in FIG. 7 are angled away from the inside surface 24. This angle is formed between a distal end of the tab 14 and the inside surface 24. The tab 14, when in this flexed or released state, is at a distance X2 from the centerline of the cover 12. A comparison of FIG. 6 (grille attached state) to FIG. 7 (grille release state) illustrates the flexing of the tab 14. The distance X2 in FIG. 7 is greater than the distance X1. By reducing or eliminating the interference between the inside surface 24 and the tabs 14, the grille 10 can now be easily removed from the trim ring 18.

Preferably, pressure is applied by hand to the cover 12 to thereby disengage the tabs 14 from the inside surface 24. However, alternatively or in addition to pushing on the cover 12, a simple tool may be used to facilitate grille 10 removal. For example, a pole, plunger, or other device could be used to deform the cover 12. With the tabs 14 retracted, the grille 10 is removed from the loudspeaker. FIG. 5(*c*) illustrates the grille 10 detached from the trim ring 18.

With the grille 10 removed and the plurality of tabs 14 free of the channel 22, the loudspeaker is accessible for adjustments. These adjustments may include, for example, crossover settings, tweeter alignment, attenuator adjustment and the like.

To re-install the grille 10, the cover 12 is deformed back into the grabbing or convex shape, which is illustrated most clearly in FIG. 1. This deformation preferably occurs with the tabs 14 removed from the channel 22. However, one with ordinary skill in the art would recognize that the plurality of tabs 14 could be completely or partially installed within the channel 22 when the cover 12 is subsequently deformed from the concave shape and into the convex shape.

With the tabs removed from the channel 22, a backside surface of the cover 12 is accessible for the installer to apply pressure to the cover 12 and thereby deform or pop the cover 12 back into the convex shape. While in the convex shape, the tabs 14 may be angled towards the centerline of the cover 12. Once in the convex shape, the installer pushes an outer perimeter of the cover 12 to force the plurality of tabs 14 into the channel 22 and thereby installs the grille 10 to the trim ring 18.

To achieve an interference fit between the inside wall 24 of the channel 22 and the plurality of tabs 14, the radius between the plurality of tabs 14 and the centerline of the cover 12 is preferably less than the dimension X1 when the cover 12 is in the convex shape and the tabs 14 are removed from the channel 22. Thus, the plurality of tabs 14 may be slightly angled towards the centerline of the cover 12. With the radius less than X1 when the grille 10 is removed from the trim ring 18, an interference fit can be achieved when the plurality of tabs 14 are inserted into the channel 22.

The distal most ends of the plurality of tabs 14 may be rounded or chamfered to ease their insertion into the channel 22. By chamfering the ends of the plurality of tabs 14, the plurality of tabs 14 flex slightly outward when installed onto the trim ring 18. Once the plurality of tabs 14 flexes slightly outward as the tabs slid along the inside wall 24 and into the channel 22, the tabs 14 are spaced at a distance X1 from the centerline of the cover 12 as explained above.

Alternatively, the removed grille 10 is re-installed into the trim ring 18 when the cover 12 is in the release or concave shape. For example, an installer inserts the plurality of tabs 14 into the channel 22 with the plurality of tabs 14 flexed or angled away from the centerline of the cover 12. With the plurality of tabs 14 so arranged, any interference between the tabs 14 and the inside wall 24 of the channel 22 is minimized or eliminated. By minimizing the interference, the plurality of tabs 14 may be more easily slid into the channel 22 as compared to when the plurality of tabs 14 are flexed towards the center line of the cover 12 as previously described. If the grille 10 is installed into the trim ring 18 with the plurality of tabs 14 flexed away from the centerline of the cover 12 (see FIG. 7), the plurality of tabs 14 are subsequently flexed towards the centerline of the cover 12 to thereby attach the grille 10 to the trim ring 18 (see FIG. 6). Once the grille 10 is placed in position onto the flange 16 or trim ring 18, the edges of the grille 10 are slightly pressed so the grille 10 pops up from its previous concave position. For example, an installer could tap or squeeze around the cover surface to thereby trigger the cover 12 to pop away from the loudspeaker. The movement of the cover would trigger the plurality of tabs 14 to flex back towards the centerline of the cover 12 and grip onto the trim ring 18.

If the pluralities of tabs 14 are triggered when the tabs are installed into the channel 22, the tabs may or may not actually move towards the centerline of the cover 12. For example, the tabs 14 may not move towards the inside wall 24 if the tabs 14 were in contact with the inside wall 24 when the cover 12 was in the concave shape. However, an interference fit between the inside wall 24 and the tabs 14 is formed when the cover 12 is in the holding or convex shape.

Grille badges, logos or other add-ons to the cover 12 as well as indents or tabs in or on the grille 10 could also be used as a gripping area to pull or push the cover 12 between the detach or release state and the attach or holding state of the cover 12.

This simple design provides an inexpensive way to attach and detach a grille 10 from an in-wall loudspeaker in ceilings or other surfaces, such as walls 32, quickly and without using tools or other complicated means.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. A grille configured to releasably attach to a circular receiving member of a loudspeaker, the receiving member having a diameter which defines a contact surface, the loudspeaker being configured to broadcast sound through the grille, the grille comprising:

a cover configured to reversibly deform between a static convex state and a static concave state, the cover remaining in at least the static concave state in the absence of an external force being applied to the cover; and a plurality of flexible tabs spaced about the cover and forming a first inside diameter when the cover is in the static convex state and forming a second inside diameter when the cover is in the static concave state, wherein the first inside diameter is less than the second inside diameter, and wherein the first inside diameter is less than the diameter of the contact surface on the receiving member so as to create an interference fit between the grille and the receiving member at least when the cover is in the static convex state, and wherein the plurality of flexible tabs is spaced from the contact surface when the cover is in the static concave state so that the grille is easily removable from the loudspeaker.

2. The grille of claim 1, wherein the receiving member is a trim ring.

3. The grille of claim 1, wherein the receiving member is a flange.

4. The grille of claim 1, wherein the cover is perforated.

5. The grille of claim 1, wherein the plurality of flexible tabs is integral to the cover.

6. The grille of claim 1, wherein the cover and the plurality of tabs are separately manufactured and attached together.

7. The grille of claim 1, wherein the grille is made of plastic.

8. The grille of claim 1, wherein the grille is made of metal.

9. A loudspeaker assembly configured to fit in a wall, the loudspeaker assembly comprising:

a loudspeaker;

a receiving member having a diameter defining a contact surface; and a grille having, a cover configured to reversibly deform between a static convex state and a static concave state, the cover remaining in at least the static concave state in the absence of an external force being applied to the cover, and a plurality of flexible tabs spaced about the cover and forming a first inside diameter when the cover is in the static convex state and forming a second inside diameter when the cover is in the static concave state, wherein the first inside diameter is less than the second inside diameter, and wherein the first inside diameter is less than the diameter of the contact surface on the receiving member so as to create an interference fit between the grille and the receiving member at least when the cover is in the static convex state, and wherein the plurality of flexible tabs is spaced from the contact surface when the cover is in the static concave state so that the grille is easily removable from the loudspeaker.

10. The loudspeaker assembly of claim 9, wherein the receiving member is a trim ring.

11. The loudspeaker assembly of claim 9, wherein the receiving member is a flange.

12. The loudspeaker assembly of claim 9, wherein the cover is perforated.

13. The loudspeaker assembly of claim 9, wherein the plurality of flexible tabs is integral to the cover.

14. The loudspeaker assembly of claim 9, wherein the cover and the plurality of tabs are separately manufactured and attached together.

15. The loudspeaker assembly of claim 9, wherein the grille is made of plastic.

16. The loudspeaker assembly of claim 9, wherein the grille is made of metal.

17. A grille configured to releasably attach to a receiving member of a loudspeaker, the receiving member having a contour which defines a contact surface, the loudspeaker being configured to broadcast sound through the grille, the grille comprising:

a cover configured to reversibly deform between a first stable state and a second stable state, the cover remaining in at least the second stable state in the absence of an external force being applied to the cover, said cover forming a first inside diameter when the cover is in the first stable state and forming a second inside diameter when the cover is in the second stable state, wherein the first inside diameter is different than the second inside diameter such that the cover only engages the contact surface when the cover is in the first stable state.

18. The grille of claim 17, wherein the cover has a convex shape when in the first state.

19. The grille of claim 17, wherein the cover has a concave shape when in the second state.

20. The grille of claim 17 further comprising a plurality of tabs spaced about the cover, wherein the tabs define the first inside diameter and the second inside diameter.

21. The grille of claim 17, wherein the receiving member is a trim ring.

22. The grille of claim 17, wherein the receiving member is a flange.

23. The grille of claim 17, wherein the cover is perforated.

24. The grille of claim 20, wherein the plurality of flexible tabs is integral to the cover.

25. The grille of claim 20, wherein the cover and the plurality of tabs are separately manufactured and attached together.

26. The grille of claim 17, wherein the grille is made of plastic.

27. The grille of claim 17, wherein the grille is made of metal.

28. A loudspeaker assembly configured to fit in a wall, the loudspeaker assembly comprising:

a loudspeaker;

a receiving member having a diameter defining a contact surface; and a grille having, a cover configured to reversibly deform between a first stable state and a second stable state, the cover remaining in at least the second stable state in the absence of an external force being applied to the cover, said cover forming a first inside diameter when the cover is in the first stable state and forming a second inside diameter when the cover is in the second stable state, wherein the first inside diameter is different than the second inside diameter such that the cover only engages the contact surface when the cover is in the first stable state.

29. The loudspeaker assembly of claim 28, wherein the cover has a convex shape when in the first state.

30. The loudspeaker assembly of claim 28, wherein the cover has a concave shape when in the second state.

31. The loudspeaker assembly of claim 28 further comprising a plurality of tabs spaced about the cover, wherein the tabs define the first inside diameter and the second inside diameter.

32. The loudspeaker assembly of claim 28, wherein the receiving member is a trim ring.

33. The loudspeaker assembly of claim 28, wherein the receiving member is a flange.

34. The loudspeaker assembly of claim 28, wherein the cover is perforated.

35. The loudspeaker assembly of claim 31, wherein the plurality of flexible tabs is integral to the cover.

36. The loudspeaker assembly of claim 31, wherein the cover and the plurality of tabs are separately manufactured and attached together.

37. The loudspeaker assembly of claim 28, wherein the grille is made of plastic.

38. The loudspeaker assembly of claim 28, wherein the grille is made of metal.

* * * * *